United States Patent [19]

Aoyama

[11] 4,186,698

[45] Feb. 5, 1980

[54] ENGINE EXHAUST GAS RECIRCULATION CONTROL SYSTEM

[75] Inventor: Syunichi Aoyama, Yokohama, Japan

[73] Assignee: Nissan Motor Company, Limited, Yokohama, Japan

[21] Appl. No.: 851,954

[22] Filed: Nov. 16, 1977

[30] Foreign Application Priority Data

Nov. 19, 1976 [JP] Japan ..... 51-139871

[51] Int. Cl.[2] ..... F02M 25/06

[52] U.S. Cl. ..... 123/119 A

[58] Field of Search ..... 123/119 A; 60/278

[56] References Cited

U.S. PATENT DOCUMENTS

| | | | |
|---|---|---|---|
| 3,776,207 | 12/1973 | Simko | 123/119 A |
| 4,031,871 | 6/1977 | Hamanishi | 123/119 A |
| 4,092,960 | 6/1978 | Nohira et al. | 123/119 A |

*Primary Examiner*—Louis J. Casaregola

*Attorney, Agent, or Firm*—Schwartz, Jeffery, Schwaab, Mack, Blumenthal & Koch

[57] ABSTRACT

A restriction is formed in a branch passage of the exhaust gas passageway of an engine having a plurality of combustion chambers, which passage communicates at its upstream end with only a part of the combustion chambers of the engine, to divide the branch passage into upstream and downstream sections, and the EGR passageway connects the upstream section and the induction passageway of the engine, and the EGR rate is controlled by controlling a vacuum for operating the EGR control valve in accordance with the pressure differential between the upstream and downstream sections and/or a venturi vacuum to control the degree of opening of the EGR control valve and therefore the pressure differential between the sections and therefore the flow rate of exhaust gases passing through the restriction.

15 Claims, 2 Drawing Figures

ENGINE EXHAUST GAS RECIRCULATION CONTROL SYSTEM

BACKGROUND OF THE INVENTION

1. Field of the Invention

The present invention relates generally to an exhaust gas recirculation (EGR) control system for reducing the production of nitrogen oxides ($NO_x$) by combustion of an air-fuel mixture in an internal combustion engine by recirculating a controlled amount of exhaust gases of the engine into the engine intake air and particularly to an EGR control system which is provided with an additional expedient for controlling the amount of recirculated exhaust gases in cooperation with an EGR control valve.

2. Description of the Prior Art

As is well known in the art, in a conventional EGR control system the amount of recirculated exhaust gases has been controlled in accordance with the amount of engine intake air by operating the EGR control valve by a vacuum signal such as, for example, a venturi vacuum produced in a carburetor. Although the degree of opening of the EGR control valve is correctly controlled by the venturi vacuum representing a function of the flow rate of engine intake air, since the temperature and pressure of exhaust gases passing through the EGR control valve variously vary in accordance with an operating condition of the engine, it has been difficult to control the EGR rate, that is, the ratio of the flow rate of recirculated exhaust gases to the flow rate of engine intake air, to a predetermined value at all times.

It is necessary to reduce the error of the accuracy of exhaust gas recirculation control as much as possible for effectively reducing the production of nitrogen oxides concurrently with insuring the stability of operation of the engine. This is especially necessary when the exhaust gas recirculation is performed at an EGR rate of a high value.

From the fact that the amount of exhaust gases emitted from each of the combustion chambers of an engine having a plurality of combustion chambers is exactly at a constant rate to the total amount of exhaust gases emitted from all the combustion chambers of the engine, the inventor has discovered that it is possible to make the error of the control of the EGR rate smaller by mainly recirculating exhaust gases from a part of the combustion chambers into the intake passageway of the engine and by controlling the EGR amount on the basis of the amount of the exhaust gases from the part of the combustion chambers.

To take as an example an engine having four combustion chambers, the amount of exhaust gases emitted from one combustion chamber of the engine is exactly 25% of the amount of exhaust gases emitted from all the combustion chambers. Accordingly, if all exhaust gases from the one combustion chamber are recirculated into the intake passageway of the engine, the EGR rate exactly becomes 25%. If only a part of exhaust gases from the one combustion chamber is recirculated, the EGR rate becomes below 25%. Conversely, if a part of exhaust gases emitted from the remaining combustion chambers is recirculated together with all exhaust gases from the one combustion chamber, the EGR rate becomes above 25%. Since the average EGR rate becomes frequently about 25% in current EGR systems which recirculate a great deal of engine exhaust gases, it is very significant in accuracy of the control of the EGR rate to take 25% as a basis of the EGR rate.

SUMMARY OF THE INVENTION

It is, therefore, an object of the invention to provide an EGR control system in which the EGR rate is accurately controlled by taking as a basis of the EGR rate the amount of exhaust gases emitted from a part of all the combustion chambers of an internal combustion engine having a plurality of combustion chambers.

This object is accomplished in this manner: A branch passage is branched off from the exhaust gas passageway of the engine and communicates at an upstream end thereof with only the part of all the combustion chambers of the engine. A restriction is provided in the branch passage to divide it into upstream and downstream sections. The EGR passageway is branched off from the upstream section of the branch passage. A working vacuum in an operating device of the EGR control valve is controlled in accordance with a parameter such as, for example, the pressure differential between the upstream and downstream sections or a venturi vacuum which represents a function of the flow rate of intake air of the engine. The EGR rate is controlled by controlling by the controlled working vacuum the degree of opening of the EGR control valve and therefore the flow rate of exhaust gases recirculated through the EGR passageway into the intake passageway, the pressure differential between the upstream and downstream sections, and the flow rate of exhaust gases passing from the upstream section into the downstream section through the restriction or vice versa.

BRIEF DESCRIPTION OF THE DRAWINGS

This and other features and advantages of the invention will become more apparent from the following detailed description taken in connection with the accompanying drawings in which.

DESCRIPTION OF PREFERRED EMBODIMENTS

Figure 1:
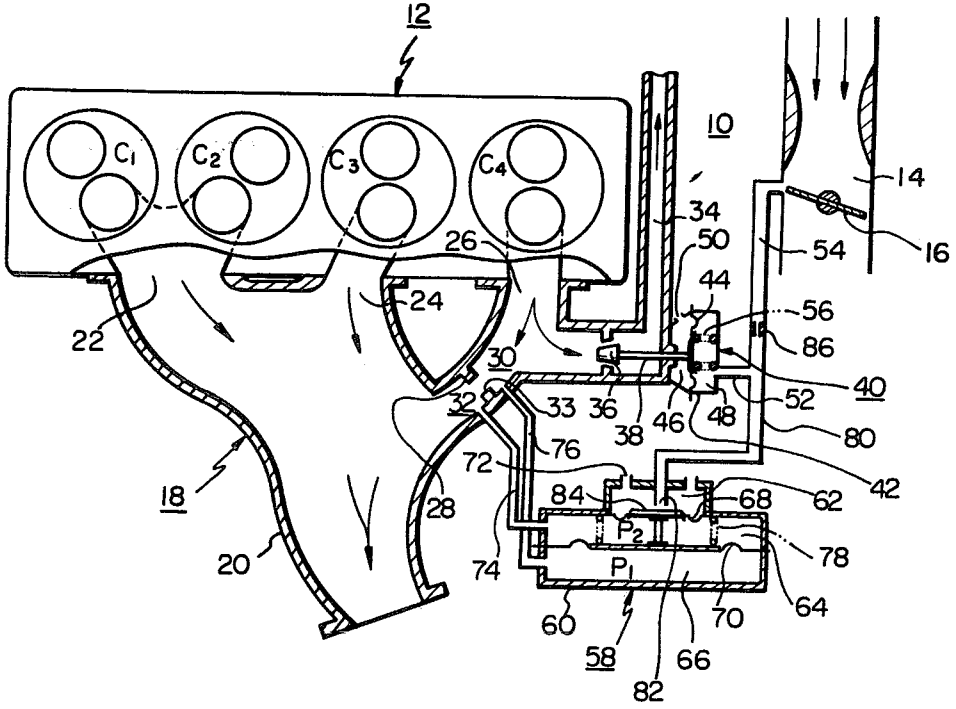
FIG. 1 is a schematic cross sectional view of a first preferred embodiment of an exhaust gas recirculation control system according to the invention.

Referring to FIG. 1 of the drawings, there is shown an exhaust gas recirculation (EGR) control system according to the invention. The EGR control system, generally designated by the reference numeral 10, is combined with an internal combustion engine 12 which is exemplified to have four combustion chambers $C_1$, $C_2$, $C_3$ and $C_4$ in this embodiment.

The engine 12 comprises an intake passageway or conduit 14 providing communication between the atmosphere and the combustion chambers $C_1$ to $C_4$ for conducting air or an air-fuel mixture thereinto, a throttle valve 16 rotatably mounted in the intake passageway 14, and an exhaust gas passageway or conduit 18 providing communication between the combustion chambers $C_1$ to $C_4$ and the atmosphere for conducting thereto exhaust gases of the engine 12. The upstream portion of the exhaust gas passageway 18 is formed of an exhaust manifold 20 which is exemplified to have three branch portions or passages or conduits 22, 24 and 26 in this embodiment. The branch passage 22 is bifurcated at an upstream end thereof so that it is connected to exhaust ports of the combustion chambers $C_1$ and $C_2$, respectively. The branch passages 24 and 26 are connected at their upstream ends respectively to exhaust ports of the combustion chambers $C_3$ and $C_4$.

The branch passage 26 is formed therein with a partition 28 which divides same into upstream and downstream sections 30 and 32. The partition 28 has formed therethrough an orifice or a restriction 33 which restricts the branch passage 26 for controlling the flow rate of exhaust gases passing from the section 30 to the section 32 or vice versa.

The EGR control system 10 comprises an EGR passageway or conduit 34 which is branched off from the upstream section 30 of the branch passage 26 and is connected to the intake passageway 14 downstream of the throttle valve 16 or to an intake manifold (not shown) of the engine 12 for recirculating or feeding exhaust gases thereof into the intake passageway 14 and for equally distributing the recirculated exhaust gases to the respective combustion chambers $C_1$ to $C_4$ through the intake passageway 14.

An EGR control valve 36 is operably disposed in the EGR passageway 34 to control the pressure of engine exhaust gases in the upstream section 30 of the branch passage 26 and therefore the difference between the pressures $P_1$ and $P_2$ of exhaust gases in the sections 30 and 32 of the branch passage 26 by controlling the effective cross sectional area of the EGR passageway 34. A valve stem 38 is connected to the EGR control valve 36 and extends externally of the EGR passageway 34.

A diaphragm unit 40 is provided for operating the EGR control valve 36 and comprises a housing 42, and a flexible diaphragm 44 dividing the interior of the housing 42 into two chambers 46 and 48. The chamber 46 communicates with the atmosphere through an opening or port 50, while the chamber 48 communicates through passages or conduits 52 and 54 with the intake passageway 14 adjacent to a peripheral edge of the throttle valve 16 in its substantially fully closed position to receive the so-called VC vacuum or an engine suction vacuum. Alternatively, the chamber 48 may communicate with the intake passageway 14 downstream of the throttle valve 16 to receive the engine suction vacuum or with another suitable vacuum source. The diaphragm 44 is operatively connected to the valve stem 38 in such a manner that the EGR control valve 36 is operated to increase and reduce the effective cross sectional area of the EGR passageway 34 in accordance with increase and decrease in a working vacuum in the chamber 48 to reduce and increase the pressure of exhaust gases in the section 30, respectively. A spring 56 is provided to urge the diaphragm 44 in a direction in which the EGR control valve 36 reduces the effective cross sectional area of the EGR passageway 34.

In order to control the pressure differential $P_1$–$P_2$ between the sections 30 and 32 of the branch passage 26 in accordance with a parameter such as, for example, the pressure differential $P_1$–$P_2$ or a venturi vacuum which represents a function of the flow rate of intake air of the engine 12 to control the flow rate of exhaust gases passing through the restriction 33 and therefore the EGR rate, a vacuum controlling device 58 is provided which is operated in accordance with the pressure differential $P_1$–$P_2$ to control the working vacuum in the chamber 48. The EGR control valve 36 is operated in accordance with the working vacuum in the chamber 48 which has been thus controlled.

The vacuum controlling device 58 comprises a housing 60 having three chambers 62, 64 and 66, and smaller and larger flexible diaphragms 68 and 70 connected integrally with each other. The diaphragm 68 separates the chambers 62 and 64 from each other, while the diaphragm 70 separates the chambers 64 and 66 from each other and has an area effective for receiving a pressure, which area is larger than that of the diaphragm 68. The chamber 62 communicates with the atmosphere through an opening or a port 72. The chamber 64 communicates with the downstream section 32 of the branch passage 26 through a passage or conduit 74 to receive the pressure $P_2$ in the section 32. The chamber 66 communicates with the upstream section 30 of the branch passage 26 through a passage or conduit 76 to receive the pressure $P_1$ in the section 30. A spring 78 is provided in the chamber 64 to urge the diaphragm 70 downwardly in the drawing. A passage or conduit 80 is provided which communicates with the passages 52 and 54 and has an open end 82 opening into the atmospheric chamber 62 to admit into the passage 80 atmospheric air for diluting the working vacuum in the chamber 48 and located, in this embodiment, near the diaphragm 68. A control valve 84 is fixedly secured to the diaphragm 68 for controlling the degree of opening of the open end 82 to the atmosphere and therefore the amount of atmospheric air, admitted into the passage 80, in accordance with movements of the diaphragm 68 in opposite directions and therefore in accordance with the pressure differential $P_1$–$P_2$ between the sections 30 and 32. The control valve 84 serves to control, by controlling the amount of atmospheric air admitted into the passage 80, the working pressure in the chamber 48 and therefore the EGR amount, that is, the amount of exhaust gases recirculated into the intake passageway 14, in accordance with an operating condition of the engine 12. The EGR amount is controlled in such a manner that the EGR rate, that is, the ratio of the flow rate of recirculated engine exhaust gases to the flow rate of air taken into the engine 12 is increased in accordance with increases in the flow rate of exhaust gases emitted from the engine 12, that is, the flow rate of the engine intake air, as described hereinafter. A restriction or orifice 86 is provided in the passage 54.

The EGR control system 10 thus described is operated in the following manner:

Since the engine 12 has the four combustion chambers $C_1$ to $C_4$, if the exhaust gases emitted from the combustion chamber $C_4$ are all fed into the intake passageway 14 through the EGR passageway 34, the EGR rate becomes correctly 25%. This condition takes place when the pressure differential $P_1$–$P_2$ between the sections 30 and 32 is zero.

If the pressure differential $P_1$–$P_2$ is positive, that is, the pressure $P_1$ in the section 30 is higher than that in the section 32, a part of the exhaust gases from the combustion chamber $C_4$ is passed into the exhaust manifold 20 through the restriction 33 and is conducted to the atmosphere together with exhaust gases emitted from the combustion chambers $C_1$ to $C_3$. The flow rate of exhaust gases passing into the exhaust manifold 20 through the restriction 33 is varied in accordance with the pressure differential $P_1$–$P_2$ between the sections 30 and 32. Accordingly, if the pressure differential $P_1$–$P_2$ is controlled in such a manner that it and therefore the flow rate of exhaust gases passing into the the section 32 through the restriction 33 are reduced and therefore the EGR amount is increased in accordance with increases in the flow rate of exhaust gases of the engine 12, which EGR amount is equal to the difference between the entire amount of exhaust gases from the combustion chamber $C_4$ and the amount of exhaust gases passing into the section 32, although the ratio of the EGR amount to the entire amount is low within an operating range in which the engine 12 produces a small quantity of exhaust gases, the ratio is gradually increased as the amount of engine exhaust gases is increased. In other words, it is possible to accurately increase the EGR rate in accordance with increase in the amount of engine intake air.

If the pressure differential between the sections 30 and 32 is controlled to a negative value, a part of exhaust gases from the combustion chambers $C_1$ to $C_3$ is passed into the EGR passageway 34 through the restriction 33. In this instance, the EGR rate is increased to above 25%.

The above-mentioned control of the pressure differential between the sections 30 and 32 is performed in the following manner.

When the pressure differential between the sections 30 and 32 is below a predetermined value, the diaphragm 70 is moved integrally with the diaphragm 68 by the force of the spring 78 overcoming the pressure differential $P_1-P_2$ between the chambers 66 and 64 into a position in which the control valve 84 fully opens the open end 82 of the passage 80. As a result, since the vacuum fed from the intake passageway 14 into the chamber 48 of the diaphragm unit 40 is sharply diluted by atmospheric air admitted into the passage 80, the diaphragm 44 of the diaphragm unit 40 is operated by the force of the spring 56 into a position in which the EGR control valve 36 fully closes the EGR passageway 34. Thus, when the engine 12 is in an operating condition such as idling in which it produces a small quantity of exhaust gases and the pressure differential between the sections 30 and 32 is very small, the recirculation of exhaust gases into the intake passageway 14 is stopped to assure the stability of operation of the engine 12 and the exhaust gases from the combustion chamber $C_4$ are all passed into the exhaust manifold 20.

When the flow rate of engine exhaust gases, that is, the flow rate of engine intake air, is gradually increased so that the pressure differential between the sections 30 and 32 is increased to the predetermined value, the diaphragm 70 is moved by the pressure differential $P_1-P_2$ between the chambers 66 and 64 overcoming the force of the spring 78 and by the diaphragm 68, moved by the difference between the pressure $P_2$ in the chamber 64 and the atmospheric pressure in the chamber 62, into a position in which the control valve 84 reduces the degree of opening of the open end 82 to the atmosphere. As a result, since the amount of atmospheric air admitted into the passage 80 is reduced to reduce the degree of dilution of the working vacuum in the chamber 48 by atmospheric air, the diaphragm 44 of the diaphragm unit 40 is moved in response to the reduced working vacuum in opposition to the force of the spring 56 into a position in which the EGR control valve 36 opens the EGR passageway 34 a certain amount to cause a part of exhaust gases emitted from the combustion chamber $C_4$ to pass into the EGR passageway 34 and the remainder of the exhaust gases to pass into the exhaust manifold 20 through the restriction 33.

When the flow rate of the engine exhaust gases is further increased so that the pressure differential between the sections 30 and 32 is further increased, since the diaphragms 68 and 70 are integrally further moved into a position in which the control valve 84 further reduces the degree of opening of the open end 82 to the atmosphere, the diaphragm 44 is moved to increase the degree of opening of the EGR control valve 36 and therefore the amount of exhaust gases fed through the EGR passageway 34 into the intake passageway 14 to prevent the pressure $P_1$ in the section 30 from being increased above a set value. Thus, the pressure differential $P_1-P_2$ between the sections 30 and 32 is controlled in such a manner that it is gradually reduced in accordance with increase in the pressure $P_2$ acting on the diaphragm 68 and therefore increase in the flow rate of the engine exhaust gases. Accordingly, since the flow rate of exhaust gases passing into the exhaust manifold 20 through the restriction 33 is reduced in accordance with increase in the flow rate of the engine exhaust gases, the EGR amount is increased in accordance with increase in the flow rate of air passed into the engine 12 so that the EGR rate is gradually increased toward 25%.

When the flow rate of the engine exhaust gases is still further increased so that the pressure differential $P_1-P_2$ is increased with the absolute pressures $P_1$ and $P_2$ in the sections 30 and 32 both increased, the differential between the pressure $P_2$ and the atmospheric pressure acting on the diaphragm 68 begins to mainly move the diaphragms 68 and 70 in opposition to the force of the spring 78 into a position in which the control valve 84 still further reduces the degree of opening of the open end 82 to the atmosphere to cause the diaphragm unit 40 to still further increase the degree of opening of the EGR control valve 36. Because of such increase in the degree of opening of the EGR control valve 36 and an increase in the influence of the engine suction vacuum exerted on the section 30 through the EGR passageway 34, a largely increased quantity of exhaust gases is passed into the intake passageway 14 through the EGR passageway 34. As a result, even if the flow rate of the engine exhaust gases is subsequently further increased, the absolute pressure $P_1$ of exhaust gases in the section 30 is prevented from being increased and at a certain period of time becomes equal to the pressure $P_2$ in the section 32. The certain period of time is determined by the mutual relationship between the area of the diaphragm 68, the spring constant of the spring 78 and the absolute pressure $P_2$ in the section 32. It is possible to set the coincidence point of the pressures $P_1$ and $P_2$ within an operating range, in which the engine 12 produces a large quantity of exhaust gases, by making the area of the diaphragm 68 relatively smaller or by making the spring constant of the spring 78 larger. When the pressures $P_1$ and $P_2$ coincide with each other, the exhaust gases from the combustion chamber $C_4$ are not passed into the section 32 but are all passed into the intake passageway 14 through the EGR passageway 34 so that the EGR rate correctly becomes 25%.

When the flow rate of the engine exhaust gases is further increased to increase the absolute pressure $P_2$ of exhaust gases in the section 32 and the exhaust manifold 20, since the degree of opening of the EGR control valve 36 is further increased by the working vacuum in the chamber 48 which is increased by the control of the vacuum controlling device 58, the pressure $P_2$ in the section 32 becomes higher than the pressure $P_1$ in the section 30. Accordingly, the pressure differential $P_1-P_2$ between the sections 30 and 32 is varied from positive to negative conversely to before. As a result, a part of the exhaust gases emitted from the combustion chambers $C_1$ to $C_3$ is passed into the EGR passageway 34 through the restriction 33 and the section 30. Thus, when the engine 12 is in an operating range in which the production of nitrogen oxides ($NO_x$) is increased, such as during a high load operating condition, the EGR rate is increased above 25% so that the EGR control system 10 is capable of preventing increase in the production of nitrogen oxides.

When it is undesired for the EGR rate to increase above 25%, this is attained by replacing the diaphragm 68 by a partition, with a valve stem slidably passing through the partition which integrally connects the diaphragm 70 and the control valve 84 to each other, and hermetically sealing the chamber 64 from the chamber 62. As a result, since the control valve 84 is operated by only the diaphragm 70 moved in accordance with the pressure differential $P_1$–$P_2$, it is possible to maintain the pressure differential $P_1$–$P_2$ at a predetermined or constant value at most times. Accordingly, since the flow rate of exhaust gases passing through the restriction 33 becomes a predetermined or constant value, the EGR rate becomes below 25%. A flexible diaphragm may be employed as a seal member for hermetically sealing the chamber 64 from the chamber 62.

Figure 2:
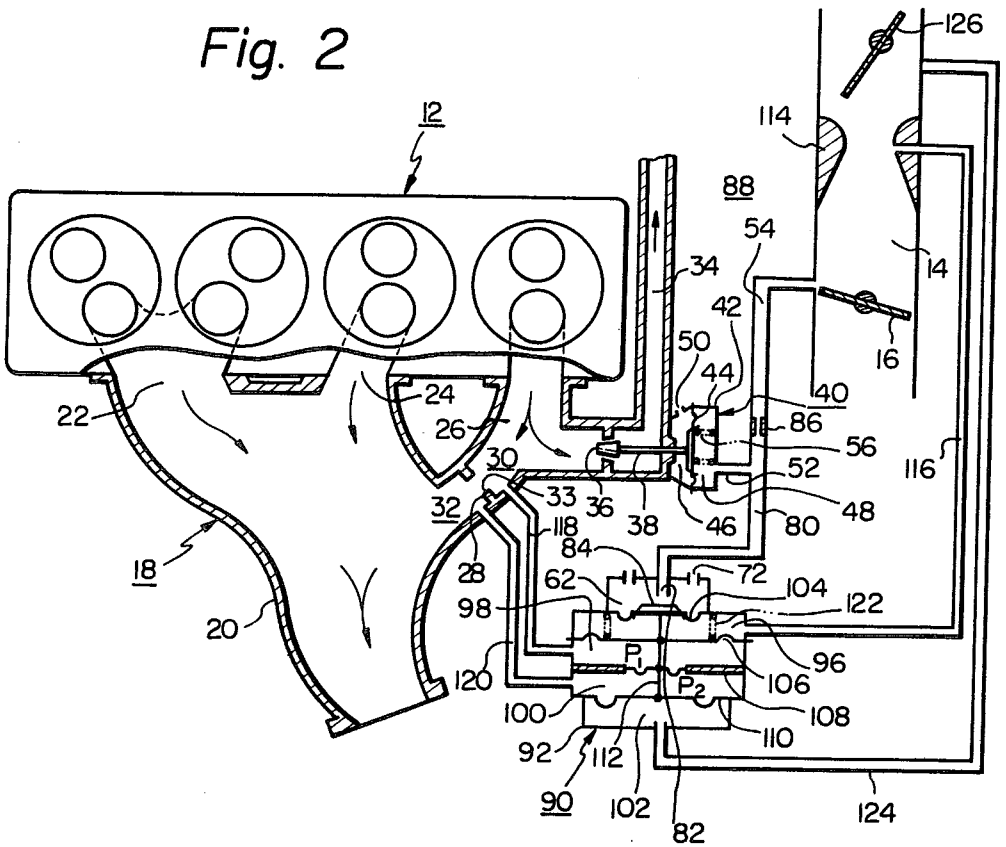
FIG. 2 is a schematic cross sectional view of a second preferred embodiment of an exhaust gas recirculation control system according to the invention.

Referring to FIG. 2 of the drawings, there is shown a further preferred embodiment of an EGR control system according to the invention. In FIG. 2 the same component elements as those of the EGR control system 10 shown in FIG. 1 are designated by the same reference numerals as those used in FIG. 1 and with respect to FIG. 2 the description as to the same component elements is omitted for brevity. The EGR control system, generally designated by the reference numeral 88, is characterized in that a venturi vacuum representing a function of the flow rate of engine intake air is applied to a diaphragm of a vacuum controlling device of the system 88 corresponding to the diaphragm 68 of the vacuum control device 58 of FIG. 1 as an input control signal or a factor which determines the coincidence point of the pressures $P_1$ and $P_2$ of exhaust gases in the sections 30 and 32, in place of the exhaust gas pressure $P_2$ in the section 32, that is, the flow rate of the engine exhaust gases, applied to the diaphragm 68 in the EGR control system 10 of FIG. 1.

As shown in FIG. 2, the vacuum control device 90 comprises a housing 92 having five chambers 62, 96, 98, 100 and 102. A flexible diaphragm 104 separates the chambers 62 and 96 from each other. A flexible diaphragm 106 separates the chambers 96 and 98 from each other and has an area effective for receiving a pressure which is greater than that of the diaphragm 104. A partition 108 separates the chambers 98 and 100 from each other. A flexible diaphragm 110 separates the chambers 100 and 102 from each other. The diaphragms 104, 106 and 110 are integrally connected to each other by rod means 112 extending through the partition 108. The chamber 96 communicates with a venturi 114 formed in the intake passageway 14 upstream of the throttle valve 16 through a passage or conduit 116. The chamber 98 communicates with the section 30 of the branch passage 26 through a passage or conduit 118 to receive the pressure $P_1$. The chamber 100 communicates with the section 32 of the branch passage 26 through a passage or conduit 120 to receive the exhaust gas pressure $P_2$. The chamber 102 may simply communicate with the atmosphere in an embodiment not illustrated. The diaphragm 104 is operatively connected to the control valve 84 similarly to the diaphragm 68 of FIG. 1. A spring 122 is provided in the chamber 96 to urge the diaphragm 106 in a direction opposed by the pressure $P_1$ in the chamber 98.

The EGR control system 88 thus described is operated in the following manner.

When the pressure $P_1$ in the section 30 is increased due to increase in the flow rate of the engine exhaust gases so that the pressure differential between the sections 30 and 32 exceeds a predetermined value which is determined in accordance with the venturi vacuum, that is, the flow rate of the engine intake air, the diaphragms 104, 106 and 110 are moved by the difference between the pressure $P_1$ and the venturi vacuum acting on the diaphragm 106 overcoming the force of the spring 122 and the difference between the pressure $P_2$ and the atmospheric pressure acting on the diaphragm 110 in a direction in which the control valve 84 reduces the degree of opening of the open end 82 of the passage 80 to the atmosphere. As a result, since the working vacuum in the chamber 48 of the diaphragm unit 40 is increased to increase the degree of opening of the EGR control valve 36, the flow rate of exhaust gases fed into the intake passageway 14 through the EGR passageway 34 is increased to prevent an excessive increase in the pressure differential between the sections 30 and 32 and therefore an excessive increase in the flow rate of exhaust gases passing into the section 32 through the restriction 33 to maintain the EGR amount at a predetermined value based on the venturi vaccum.

Thus, similarly to the EGR control system 10 described hereinbefore, the EGR amount is correctly increased in accordance with increase in the flow rate of engine intake air. Furthermore, since the pressure differential between the sections 30 and 32 and therefore the flow rate of exhaust gases passing from the section 30 into the section 32 is gradually reduced in accordance with increase in the venturi vacuum, the EGR rate is accurately increased toward 25% in accordance with increase in the flow rate of the engine intake air.

When the flow rate of the engine intake air is increased above a predetermined value, although the venturi vacuum is increased to increase the difference between the atmospheric pressure and the venturi vaccum urging the diaphragm 104 in a direction in which the control valve 84 increases the degree of opening of the open end 82, the diaphragms 104, 106 and 110 are moved by the difference between the pressure $P_1$ and the venturi vacuum acting on the diaphragm 106 due to the area differential between the diaphragms 104 and 106 into a position in which the control valve 84 further reduces the degree of opening of the open end 82 to the atmosphere. As a result, since the control vacuum in the chamber 48 is further increased to further increase the degree of opening of the EGR control valve 36 to cause increase in the flow rate of exhaust gases emitted from the combustion chamber $C_4$ and passing into the intake passageway 14 through the EGR passageway 34, the rate of increase in the pressure $P_1$ in the section 30 to increase in the flow rate of the engine intake air is subsequently reduced. On the contrary, since the pressure $P_2$ in the section 32 is increased equally to the pressure of exhaust gases emitted from the combustion chambers $C_1$ to $C_3$, the pressure differential between the sections 30 and 32 is gradually reduced in accordance with increase in the flow rate of the engine intake air and is finally reduced to zero. At this time, the EGR rate is 25%.

When the flow rate of the engine intake air is still further increased, since the EGR control valve 36 is operated to still further increase the effective cross sectional area of the EGR passageway 34, the pressure differential $P_1$–$P_2$ between the sections 30 and 32 is varied from positive to negative to cause a part of the exhaust gases in the exhaust manifold 20 to pass into the section 30 through the restriction 33. As a result, the EGR amount is increased above the entire amount of exhaust gases emitted from the combustion chamber $C_4$. Accordingly, the EGR rate becomes above 25%.

In the illustrated embodiment, the chamber 102 communicates through a passage or conduit 124 with the intake passageway 14 between the venturi 114 and a choke valve 126 rotatably mounted in the intake passageway 14 upstream of the venturi 114. As a result, when the choke valve 126 is closed as during cold engine operations, since the chamber 102 is fed with a high vacuum corresponding to the engine suction vacuum to move the diaphragms 104, 106 and 110 into a position in which the control valve 84 fully opens the open end 82, it is possible to have the EGR control valve 36 stop the recirculation of engine exhaust gases into the intake passageway 14, for example, during engine starting when the engine 12 is at a low temperature.

Since in an EGR control system according to the invention the amount of exhaust gases emitted from a part of all the combustion chambers of an engine is employed as a basic EGR rate, which is the amount of exhaust gases from one of four combustion chambers, that is, 25%, in the described embodiments, and the EGR rate is controlled on the basis of the basic EGR rate in accordance with a parameter such as, for example, the pressure differential $P_1$–$P_2$ between the sections 30 and 32 and/or the venturi vacuum, when the basic EGR rate is selected as the mean EGR rate it is possible to maintain the accuracy of control of the EGR rate at a very desirable value within an engine operating range in which the EGR rate is equal to or near the mean EGR rate and the period of occurrence of which is longer than the period of occurrence of each of all other engine operating ranges. As a result, it is possible to strikingly improve the operative performance and the fuel consumption of the engine and concurrently to reduce the production of nitrogen oxides ($NO_x$).

Although when an engine has four combustion chambers as in the described embodiments, a basic EGR rate is 25%, it will be easily understood that when the amount of exhaust gases emitted from one combustion chamber of an engine having six combustion chambers is employed as the basis of the EGR rate, a basic EGR rate is 16.6%, and also that when the amount of exhaust gases emitted from two combustion chambers of the engine is employed, a basic EGR rate is 33.3%.

When the exhaust gases emitted from two combustion chambers of the six combustion chamber engine are recirculated, since the EGR rate is about 33% even when the pressure differential between the sections 30 and 32 is zero, even if the pressure differential is at all times maintained positive, deficiency of the EGR amount will not occur. In such a case, it is possible to employ as each of the springs 78 and 122 of the vacuum control devices 58 and 90 a spring the force of which is great or to omit the diaphragm 104 of the vacuum control device 90.

Although in both the EGR control systems 10 and 88 the pressure differential between the sections 30 and 32 varies undulatingly at a frequency in accordance with the number of revolutions of the engine 12 due to the pulsation of exhaust gases, the mean pressure differential due to the exhaust gas pulsation is maintained constant because of a delay of response of each of the vacuum control devices 58 and 90 and so on.

It will be appreciated that the invention provides an EGR control system which employs as a basic EGR rate the amount of exhaust gases emitted from a part of the combustion chambers of an engine so that the EGR rate is highly accurately controlled to a desired value during an engine operating condition in which the recirculation of exhaust gases is performed at a high EGR rate equal to or near the basic EGR rate and the period of occurrence of which is longer than that of occurrence of each of other engine operating conditions, and therefore the production of nitrogen oxides is effectively reduced concurrently with the operative performance and the fuel economy of the engine being increased.

It will be also appreciated that the invention provides an EGR control system which is simple in construction, inexpensive in production cost, and high in reliability of control and in durability.

What is claimed is:

1. An exhaust gas recirculation control system in combination with an internal combustion engine, comprising:

a plurality of combustion chambers, including a first set comprising at least one combustion chamber and a second set comprising the remaining combustion chambers;

intake passage means providing communication between the atmosphere and said plurality of combustion chambers for conducting air thereinto;

branched exhaust gas passage means for conducting exhaust gases emitted from the engine to the atmosphere, including a first branch communicating with said first set of combustion chambers and a second branch communicating with said second set of combustion chambers;

a restriction dividing said first branch into upstream and downstream sections, said upstream section being closer to said first set of combustion chambers than said downstream section; and means for controlling exhaust gas recirculation to said combustion chambers, comprising:

an exhaust gas recirculation (EGR) passageway providing communication between said upstream section and said intake passage means;

an EGR control valve disposed in said EGR passageway;

a source of fluid pressure;

means, responsive to vacuum produced in said intake passage means, for opening and closing said EGR control valve to control the rate of exhaust gases recirculated; and means, responsive to at least the pressure of exhaust gases in said upstream portion of said first branch of the exhaust gas passage means, for controlling the vacuum supplied to said valve opening and closing means by selectively supplying to said valve opening and closing means fluid pressure from said fluid pressure source.

2. An exhaust gas recirculation control system as claimed in claim 1, wherein said valve opening and closing means comprises:

a vacuum chamber communicating with the intake passage means for receiving said vacuum therefrom, and operating means operatively communicating with said vacuum chamber and being connected to said EGR control valve, and wherein said vacuum controlling means comprises:

first passage means communicating with said vacuum chamber and having an open end which communicates with the atmosphere for admitting into said first passage means atmospheric air for controlling said vacuum, a first chamber communicating with said upstream section, a second chamber communicating with said downstream section, and control means for controlling the amount of atmospheric air admitted into said first passage means through said open end, in response to the pressure differential between said first and second chambers.

3. An exhaust gas recirculation control system as claimed in claim 2, in which said atmospheric air control means comprises a first flexible diaphragm separating said first and second chambers from each other, and a first control valve connected to said diaphragm which valve is operated thereby for controlling the degree of opening of said open end to the atmosphere.

4. An exhaust gas recirculation control system as claimed in claim 3, in which said EGR control valve, said vacuum chamber and said valve opening and closing means are constructed and arranged relative to each other so that the degree of opening of said EGR control valve is increased and reduced in accordance with increase and decrease in said vacuum in said vacuum chamber, respectively, said first and second chambers, said diaphragm and said first control valve are arranged relative to each other so that the degree of opening of said first control valve is increased and reduced in accordance with decrease and increase in the pressure in said first chamber, respectively and in accordance with increase and decrease in the pressure in said second chamber, respectively.

5. An exhaust gas recirculation control system as claimed in claim 4, in which said vacuum controlling means further comprises a spring located in said second chamber for urging said diaphragm in a direction in which the degree of opening of said first control valve is increased.

6. An exhaust gas recirculation control system as claimed in claim 4, in which said vacuum controlling means comprises a second flexible diaphragm integrally connected to the first diaphragm and having an area effective for receiving a pressure which is smaller than the area of said first-mentioned diaphragm, said second diaphragm having on one side thereof said second chamber and being operatively connected to said first control valve.

7. An exhaust gas recirculation control system as claimed in claim 2, in which atmospheric air control means comprises a first flexible diaphragm separating said first and second chambers from each other, a second flexible diaphragm integrally connected to said first diaphragm and arranged parallel with same and having on one side thereof said second chamber, and a first control valve connected to said second diaphragm for operation thereby for controlling the degree of opening of said open end to the atmosphere.

8. An exhaust gas recirculation control system as claimed in claim 7, in which said EGR control valve, said vacuum chamber and said valve opening and closing means are constructed and arranged relative to each other so that the degree of opening of said EGR control valve is increased and reduced respectively in accordance with increase and decrease in said vacuum in said vacuum chamber, said first and second chambers and said first control valve are arranged relative to each other so that the degree of opening of said first control valve is increased and reduced in accordance with decrease and increase in the pressure in said first chamber, respectively and in accordance with increase and decrease in the pressure in said second chamber, respectively.

9. An exhaust gas recirculation control system as claimed in claim 8, in which said vacuum controlling means further comprises a spring located in said second chamber for urging said first diaphragm in a direction in which the degree of opening of said first control valve is increased.

10. An exhaust gas recirculation control system as claimed in claim 1, in which the intake passage means includes therein a venturi and said valve opening and closing means comprises:

a vacuum chamber communicating with the intake passage means for receiving said vacuum therefrom, and operating means operatively communicating with said vacuum chamber and being connected to said EGR control valve, and wherein said vacuum controlling means comprises:.

first passage means communicating with said vacuum chamber and having an open end which communicates with the atmosphere for admitting into said first passage means atmospheric air for controlling said vacuum, a first chamber communicating with said upstream section for receiving the pressure therein, a second chamber communicating with said downstream section for receiving the pressure therein, a third chamber communicating with the venturi in the intake passage means for receiving a venturi vacuum, and control means for controlling the amount of atmospheric air admitted into said first passage means through said open end, in response to the pressure differential between said first and second chambers and in response to said venturi vacuum in said third chamber.

11. An exhaust gas recirculation control system as claimed in claim 10, in which said control means comprises a first flexible diaphragm separating said first and third chambers from each other, a second flexible diaphragm having on one side thereof said second chamber, and a first control valve integrally connected to both said first and second diaphragms for operation thereby for controlling the degree of opening of said open end to the atmosphere.

12. An exhaust gas recirculation control system as claimed in claim 11, in which said EGR control valve, said vacuum chamber and said operating means are constructed and arranged relative to each other so that the degree of opening of said EGR control valve is increased and reduced respectively in accordance with increase and decrease in the vacuum in said vacuum chamber, said first, second and third chambers and said first control valve are arranged relative to each other so that the degree of opening of said first control valve is increased and reduced in accordance with decrease and increase in the pressure in said first chamber, respectively, in accordance with increase and decrease in the pressure in said second chamber, respectively, and in accordance with decrease and increase in the vacuum in said third chamber, respectively.

13. An exhaust gas recirculation control system as claimed in claim 12, in which said vacuum controlling means further comprises a spring located in said third chamber for urging said first diaphragm in a direction in which the degree of opening of said first control valve is increased.

14. An exhaust gas recirculation control system as claimed in claim 11, in which said vacuum controlling means further comprises a third flexible diaphragm integrally connected to said first diaphragm and having an area effective for receiving a pressure which area is smaller than that of said first diaphragm, said third diaphragm having on a side thereof said third chamber and being operatively connected to said first control valve.

15. An exhaust gas recirculation control system as claimed in claim 11, in which the engine includes a throttle valve rotatably mounted in the intake passage means, and a choke valve rotatably mounted in the intake passage means upstream of the throttle valve, said vacuum control device further comprising a fourth chamber communicating with the intake passage means between the throttle valve and the choke valve and located on the other side of said second diaphragm.

* * * * *